US005567576A

United States Patent [19]

Suzuki et al.

[11] Patent Number: 5,567,576

[45] Date of Patent: Oct. 22, 1996

[54] PHOTOGRAPHIC SUPPORT

[75] Inventors: Fumiyuki Suzuki; Toshimitu Okutu; Masaaki Otoshi, all of Shizuoka, Japan

[73] Assignee: Fuji Photo Film Co., Ltd., Kanagawa, Japan

[21] Appl. No.: 447,693

[22] Filed: May 23, 1995

[30] Foreign Application Priority Data

May 26, 1994 [JP] Japan ..... 6-113007

[51] Int. Cl.[6] ..... G03C 1/76

[52] U.S. Cl. ..... 430/533; 430/523; 430/531; 430/534; 430/535

[58] Field of Search ..... 430/533, 523, 430/534, 535, 531

[56] References Cited

U.S. PATENT DOCUMENTS 4,011,358 3/1977 Roelofs ..... 428/287

4,868,051 9/1989 Grosjean ..... 428/326

FOREIGN PATENT DOCUMENTS

86/02766 5/1986 WIPO .

*Primary Examiner*—Geraldine Letscher

*Attorney, Agent, or Firm*—Sughrue, Mion, Zinn, Macpeak & Seas

[57] ABSTRACT

A photographic support having good adhesion to a photographic emulsion layer formed thereon without physical surface modification. The support comprises a uniaxially or biaxially stretched polyester film and has at least (1) a main layer containing a polyester and (2) one or two surface layers. At least one of the surface layers comprises a substantially noncrystalline polyester. Furthermore, when used in the form of a roll film, substantially no curling of the support remains upon development.

4 Claims, No Drawings

PHOTOGRAPHIC SUPPORT

FIELD OF THE INVENTION

The present invention relates to a polyester series photographic support having good adhesion to a photographic emulsion layer formed thereon.

BACKGROUND OF THE INVENTION

Hitherto, polyethylene terephthalate has been practically used as the material of a support for sheet-form photographic materials such as X-ray photographic films, lithographic light-sensitive films, etc.

Also, the use of inexpensive polyester series supports has been proposed in place of conventional cellulose series supports for roll films such as 35 mm negative photographic films.

However, because a polyester series support does not adhere to a photographic emulsion layer formed thereon as well as a cellulose series support, various subbing agents and surface modification by physical means have been proposed for ensuring good adhesion.

The reason that a polyester series support does not adhere to a photographic emulsion layer as well as a cellulose series support is not clearly understood. However, this difference in adhesion is considered to be due to the high crystallinity of the surface of the polyester series support that is generally formed from a biaxially stretched polyester film.

It is known in the art to form a subbing layer between the support and the photographic emulsion layer, or to physically modify the surface of the support, to thereby ensure the adhesion of a photographic emulsion layer to a polyester series support.

Known subbing agent for a polyester series photographic support include polyester series polymers, vinylidene chloride series polymers, acryl series polymers, SBR series polymers, and maleic acid series polymers, etc., as described, e.g., in *Nippon Setchaku Gijyutsu Kyoukai Shi (Journal of Adhesive Technic Society of Japan),* 23, 178(1987).

Known techniques for the surface modification of a polyester support by physical means include solvent etching ultraviolet irradiation, corona discharging treatment, flame treatment, glow discharging treatment, etc., as described, e.g., in *J.Polym. Sci. Chem. Ed.,* 22, 419(1984), *J. Applied Polym. Sci.,* 19, 3315(1975), *Polymer,* 18, 675(1977), and *J. Material Sci.,* 14, 1344(1979).

These means are selected depending on the property of the photographic emulsion that is being coated on the support. Often, both physical surface treatment and a subbing agent are employed in combination.

In particular, in a photographic support comprising a polyester mainly containing polyethylene naphthalate, the combined use of physical surface modification and a subbing agent is essential. However, because the equipment is expensive and a complicated technique is required for physical surface modification, there is a need in the art to provide a polyester series support which only requires a subbing agent to provide the desired degree of adhesion.

The subbing agent is coated onto the support just before the entering a width-wise direction stretching machine or after issuing from a film making machine. However, the former system is frequently employed because adhesion of a subbing agent to a support is enhanced prior to stretching in the width-wise direction. The other reasons are that the coated layer can be dried in the oven of the width-wise direction stretching machine, the equipment can be simplified, etc.

In a roll type light-sensitive material such as a 35 mm photographic film, it is known that curling is retained by the film support caused by winding around a core. Curling a cellulose series support curling of the support is reversed in a developer due to its water-absorbing property, to thereby avoid development mottling. However, such curling cannot be reversed in a polyester series support, which in turn causes development mottling.

In order to solve the above described problem, a technique of annealing a polyester series support at a temperature of from about 5°to 20° C. lower than the glass transition temperature of the support material has been proposed to thereby impart curling resistance to the support as described, e.g., in JP-A-6-67346 (the term "JP-A" as used herein means an "unexamined published Japanese patent application"). The annealing treatment is preferably carried out before forming the coated layer on the support, namely, directly after the film-making step. The support is usually annealed in a rolled state for from 0.5 to 100 hours, and preferably from 10 to 30 hours.

SUMMARY OF THE INVENTION

An object of the present invention is to provide a polyester series photographic support having good adhesion to a photographic emulsion layer formed thereon without the need for physically modifying the surface of the support.

The above object is achieved according to the present invention by providing a photographic support comprising a uniaxially or biaxially stretched polyester film having at least (1) a main layer containing a polyester and (2) one or two surface layers, wherein at least one of the surface layers comprises a substantially noncrystalline polyester.

DETAILED DESCRIPTION OF THE INVENTION

The polyester constituting the main layer of the photographic support of the present invention is preferably a polyester mainly comprising polyethylene terephthalate or polyethylene naphthalate. The opposing surfaces of the main layer of the present invention can each have a surface layer. At least one of the surface layers of the support of the present invention preferably comprises a noncrystalline copolymerized polyester having at least two kinds of polymers selected from the group consisting of polyethylene naphthalate, polycyclohexanedimethylene terephthalate and polyethylene terephthalate.

Preferably, the glass transition temperature of the noncrystalline polyester contained in at least one of the surface layers of the photographic support of the present invention is not lower by 20° C. or more than the glass transition temperature of the polyester contained in the main layer. In other words, the noncrystalline polyester contained in at least one of the surface layers has a glass transition temperature that is not lower than the glass transition temperature of the polyester contained in the main layer by 20° C. or more.

Preferably, the thickness (a) of the main layer and the thickness (b) of the surface layer which comprises a substantially noncrystalline polyester of the photographic support of the present invention satisfy the following formula (1);

$$0.001 \leqq b/a \leqq 0.5 \quad (1)$$

The thickness of the photographic support of the present invention is preferably from 20 to 300 μm, and particularly preferably from 50 to 250 μm.

The main layer of the photographic support of the present invention substantially provides the requisite mechanical and optical characteristics of the support.

At least one of the surface layers of the photographic support of the present invention which comprises a substantially noncrystalline polyester is a layer having a surface which contacts a photographic emulsion. The function of the surface layer can be obtained even if the surface layer is thin. However, if the surface layer is too thin, holes are formed in the surface layer to degrade adhesion to a photographic emulsion layer. On the other hand, if the surface layer is too thick, the surface layer adversely affects the mechanical characteristics essential to the photographic support.

As used herein, the term "substantially noncrystalline polyester" means that a thermal change in the polyester due to crystallization is not detected by differential scanning calorimetry (DSC) measurement.

The noncrystalline polyester and the noncrystalline copolymerized polyester of the present invention can be obtained by selecting a specific composition. Suitable copolymerization ratio for preparing the noncrystalline copolymerized polyester depends on a combination of polymers used. For example, when a combination of polyethylene terephthalate and polyethylene naphthalate is used, a noncrystalline copolymerized polyester can be obtained by selecting the copolymerization mol ratio within a range of from 15:85 to 75:25. The copolymerization ratio of the combination preferably ranges from 15:85 to 70:30, and more preferably from 16:84 to 30:70. When a combination of polyethylene naphthalate and polycyclohexanedimethylene terephthalate is used, the copolymerization ratio generally ranges from 15:85 to 90:10 for obtaining a noncrystalline copolymerized polyester, and preferably from 40:60 to 85:15. When a combination of polyethylene terephthalate and polycyclohexanedimethylene terephthalate is used, the copolymerization ratio generally ranges from 10:90 to 95:5 for obtaining a noncrystalline copolymerized polyester, and preferably from 30:70 to 90:10.

The support of the present invention is a stretched film comprising two or more layers. The support may be produced using a stretching method after co-extruding, a dry lamination method on a stretched film, a wet lamination method on a stretched film, an extrusion lamination method on a stretched film, a coating method on a stretched film, etc. Of these methods, the stretching method after co-extruding is preferred because it is simple and inexpensive.

The production of the support of the present invention by stretching after co-extruding can be carried out by forming a laminated amorphous sheet (e.g., by connecting plural extruders necessary for melt-extruding the materials to be laminated to a die), and then stretching the sheet to form a film. Details of the stretching method after co-extruding are described, e.g., in U.S. Pat. No. 5,212,006.

The stretching treatment cause molecular orientations in the main layer, to thereby impart the above-described mechanical and optical characteristics to the main layer. However, effective molecular orientation is not induced in the surface layer during a stretching process because of the noncrystallinity of the surface layer.

If the glass transition temperature of the noncrystalline polyester layer is lower than the annealing temperature, the surfaces of the support adhere to each other during annealing. AS a result, the support cannot be unwound. Accordingly, when the photographic support of the present invention is annealed directly after making the film, the annealing is preferably performed at a temperature that is at least 5° C. lower than the glass transition temperature of the noncrystalline polyester.

The dicarboxylic acid components of the polyester contained in the main layer of the photographic support of the present invention preferably include polyethylene terephthalate or polyethylene naphthalate in an amount of at least 80 mol %. The dicarboxylic acid components may include an aromatic dicarboxylic acid such as 2,6-naphthalenedicarboxylic acid (when the main dicarboxylic acid component is terephthalic acid), 2,7-naphthalene-dicarboxylic acid, terephthalic acid (when the main dicarboxylic acid is 2,6-naphthalenedicarboxylic acid), isophthalic acid, etc.; an alicyclic dicarboxylic acid such as cyclohexanedicarboxylic acid, etc.; an aliphatic dicarboxylic acid such as adipic acid, sebacic acid, etc.; a dicarboxylic acid having a metal salt of sulfonic acid, etc., so long as the characteristics of the polyester for a photographic support (e.g., transparency, mechanical strength, etc.) are not adversely affected.

The glycol components of the polyester contained in the main layer of the photographic support of the present invention preferably include ethylene glycol in an amount of at least 80 mol%. The glycol components may include diethylene glycol, triethylene glycol, neopentyl glycol, tetramethylene glycol, cyclohexane dimethanol, polyethylene glycol, butanediol, xylylene glycol, an ethylene oxide addition product of bisphenol A, etc., so long as the characteristics of the polyester for a photographic support are not adversely affected.

Details of the preparation of the polyester contained in the main layer of the photographic support of the present invention are described, e.g., in U.S. Pat. Nos. 650,601, 670,319 and 5,331,082, British Patent 604,073, JP-A-1-266129, and JP-B-49-5235 (the term "JP-B" as used herein means an "examined Japanese patent publication").

The surface layer is preferably made of a noncrystalline copolymerized polyester comprising at least two kinds of polymers selected from the group consisting of polyethylene naphthalate, polycyclohexanedimethylene terephthalate and polyethylene terephthalate.

The dicarboxylic acid components of the polyester of the surface layer of the photographic support of the present invention may include an aromatic dicarboxylic acid such as 2,7-naphthalenedicarboxylic acid, isophthalic acid, etc.; an alicyclic dicarboxylic acid such as cyclohexanedicarboxylic acid, etc.; an aliphatic dicarboxylic acid such as adipic acid, sebacic acid, etc., so long as the characteristics of the polyester for a surface layer of a photographic support (e.g., adhesion, etc) are not adversely affected. The glycol components of the polyester of the surface layer may include diethylene glycol, triethylene glycol, neopentyl glycol, tetramethylene glycol, cyclohexane dimethanol, polyethylene glycol, butanediol, xylylene glycol, an ethylene oxide addition product of bisphenol A, etc., so long as the characteristics of the polyester for a surface layer of a photographic support are not adversely affected.

Details of the preparation of the noncrystalline polyester contained in the surface layer of the photographic support of the present invention are described, e.g., in JP-A-6-271829.

Subbing agents for use in the present invention which ensure the adhesion of the support of the present invention to a photographic emulsion layer are not particularly limited. However, vinylidene chloride series polymers, SBR series polymers, and polyester series polymers are preferred. Although a coating method of a subbing agent onto the support of the present invention is not particularly limited, bar coating method is preferably employed.

The present invention is described in greater detail below by reference to the following examples. However, the present invention should not be construed as being limited thereto.

Measurement Method (Glass transition temperature)

The glass transition temperature was measured using a DSC (DSC-50; manufactured by Shimadzu Corporation) at a heating rate of 10° C./minute.

Evaluation of Noncrystallinity

The temperature of each sample was raised to 300° C. using a DSC at a heating rate of 10° C./minute. After keeping the sample at 300° C. for 30 seconds, the temperature of the sample was lowered at a cooling rate of 5° C./minute. Those samples showing no generation of heat due to the crystallization were evaluated to be noncrystalline.

Adhesive Force at Dry

Line-form cuts about 4 mm in length were formed in a network-form on the photographic emulsion layer of each dried photographic film using a razor blade. A pressure-sensitive adhesive tape having a good adhesive property (Scotch Permacell Tape, trade name, manufactured by Sumitomo 3M Limited) was adhered onto the surface of the emulsion layer, and the pressure-sensitive adhesive tape was instantly released. When the released portion was from 0 to 5% in this method, the adhesive force of the emulsion layer was evaluated as grade A. When the released portion was from 5 to 30%, the adhesive force was evaluated as grade B, and when the released portion was from 30 to 100%, the adhesive force was evaluated as grade C.

Adhesive Force at Wet

Two crossed scratches were formed on the photographic emulsion layer of each photographic film in a developer using a stylus, and the scratched portion was rubbed with a finger tip in a direction perpendicular to the scratched line. In this method, when the emulsion layer was not released outside the scratched areas, the adhesive force of the emulsion layer was evaluated as grade A. When the maximum release was within 5 mm, the adhesive force was evaluated as grade B, and when the emulsion layer was released more than 5 mm, the adhesive force was evaluated as grade C.

EXAMPLE 1

Polyethylene naphthalate having a thickness of 950 μm was used as the polyester constituting the main layer. A sheet composed of the polyester layer having formed on one surface thereof a surface layer having a thickness of 50 μm composed of a copolymerized polyester of polyethylene terephthalate and polyethylene naphthalate (copolymerization ratio of 20:80) was prepared by a co-extrusion method, and the sheet was successively stretched 3.1 times in each of the lengthwise direction and the widthwise direction to provide a laminated layer film having a thickness of 100 μm. A subbing layer having the composition below was formed on the surface (the copolymerized polyester layer side) of the film. Furthermore, a silver halide emulsion was coated on the subbing layer to form a light-sensitive layer.

The glass transition temperature (Tg) of the polyethylene naphthalate constituting the main layer was 120° C. Also, the Tg of the copolymerized polyester of polyethylene terephthalate and polyethylene naphthalate (copolymerization ratio 20:80) was 111° C., and a thermal change in the polyester due to crystallization was not detected by DSC.

Composition of Subbing Layer

An emulsion polymerization product of the following components was coated onto the support.

| | |
|---|---|
| Butadiene | 38 mol % |
| Styrene | 54 mol % |
| Acrylic acid | 5 mol % |
| Itaconic acid | 3 mol % |

EXAMPLE 2

Polyethylene naphthalate having a thickness of 1200 μm was used as the polyester constituting the main layer. A sheet composed of the polyester layer having formed on both surfaces thereof a surface layer having a thickness of 100 μm composed of a copolymerized polyester of polyethylene naphthalate and polycyclohexanedimethylene terephthalate (copolymerization ratio 80:20) was prepared by a co-extrusion method, and the sheet was successively stretched 4.2 times in each of the lengthwise direction and the widthwise direction to provide a laminated layer film having a thickness of 80 μm thick. After annealing the film at 105° C. for 40 hours, a subbing layer having the same composition as in Example 1 was formed on both surfaces of the film. Furthermore, a silver halide emulsion was coated on the subbing layers to form a light-sensitive layers. After annealing, the wound surfaces of the support did not adhere to one another.

The Tg of the polyethylene naphthalate constituting the main layer was 120° C. The Tg of the copolymerized polyester of polyethylene naphthalate and polycyclohexanedimethylene terephthalate (copolymerization ratio 80:20) was 114° C., and a thermal change in the polyester due to crystallization was not detected by DSC.

EXAMPLE 3

Polyethylene terephthalate having a thickness of 950 μm was used as the polyester constituting the main layer. A sheet composed of the polyester having formed on one surface thereof a surface layer having a thickness of 50 μm composed of a copolymerized polyester of polyethylene terephthalate and polycyclohexanedimethylene terephthalate (copolymerization ratio 50:50) was prepared by a co-extrusion method, and the sheet was successively stretched 3.1 times in each of the lengthwise direction and the widthwise direction to provide a laminated layer film having a thickness of 100 μm. A subbing layer having the same composition as in Example 1 was formed on the surface (the copolymerized polyester layer side) of the film. Furthermore, a silver halide emulsion was coated on the subbing layer to form a light-sensitive layer.

The Tg of the polyethylene terephthalate constituting the main layer was 72° C. The Tg of the copolymerized polyester of polyethylene terephthalate and polycyclohexanedimethylene terephthalate (copolymerization ratio 50:50) was 75° C., and a thermal change in the polyester due to crystallization was not detected by DSC.

COMPARATIVE EXAMPLE 1

A single layer sheet of polyethylene terephthalate having a thickness of 1000 μm was prepared by a melt extrusion method and the sheet was successively stretched 3.1 times in each of the lengthwise direction and the widthwise direction to provide a film having a thickness of 100 μm. The film was used as a support. A subbing layer having the same composition as in Example 1 was formed on one surface of the support, and a silver halide emulsion was coated on the subbing layer to form a light-sensitive layer.

COMPARATIVE EXAMPLE 2

A single layer sheet of polyethylene naphthalate having a thickness of 1000 μm was prepared by a melt extrusion method and the sheet was successively stretched 3.1 times in each of the lengthwise direction and the widthwise direction to provide a film having a thickness of 100 μm.

The film was subjected to a corona discharging treatment having a magnitude of 0.38 kV·A·minute/$m^2$. A subbing layer having the same composition as in Example 1 was coated on the treated surface of the film, and a silver halide emulsion was further coated on the subbing layer to form a light-sensitive layer.

The samples obtained in the above Examples and comparative Examples were evaluated in terms of adhesion of the light-sensitive layer to the support under both dry and wet conditions.

The results obtained are shown in Table 1.

TABLE 1

| | Adhesion at Dry | Adhesion at Wet |
|---|---|---|
| Example 1 | A | A |
| Example 2 | A | A |
| Example 3 | A | A |
| Comparative Example 1 | B | C |
| Comparative Example 2 | A | B |

The above results show that the samples of the present invention had excellent adhesion of the support to the light-sensitive layer under both dry and wet conditions.

While the invention has been described in detail and with reference to specific examples, it will be apparent to one skilled in the art that various changes and modifications can be made without departing from the spirit and scope thereof.

What is claimed is:

1. A photographic support comprising a uniaxially or biaxially stretched polyester film comprising (1) a main layer containing a polyester and (2) one or two surface layers, wherein at least one of said surface layers comprises a noncrystalline polyester selected from the group consisting of copolymers of polyethylene terephthalate and polyethylene naphthalate having a copolymerization mol ratio of from 15:85 to 75:25, copolymers of polyethylene naphthalate and polycyclohexanedimethylene terephthalate having a copolymerization mol ratio of from 15:85 to 90:10, and copolymers of polyethylene terephthalate and polycyclohexanedimethylene terephthalate having a copolymerization mol ratio of from 10:90 to 95:5.

2. The photographic support of claim 1, wherein said noncrystalline polyester present in at least one surface layer (2) has a glass transition temperature that is not lower than the glass transition temperature of said polyester contained in said main layer by 20° C. or more.

3. The photographic support of claim 1, wherein said main layer (1) has a thickness (a) and said surface layer comprising a substantially noncrystalline polyester has a thickness (b) which satisfy the following formula (1)

$$0.001 \leqq b/a \leqq 5 \quad (1).$$

4. The photographic support of claim 1, wherein the polyester in the main layer is polyethylene naphthalate.

* * * * *